US005593806A

United States Patent [19]

Nishiyama et al.

[11] Patent Number: 5,593,806

[45] Date of Patent: Jan. 14, 1997

[54] TWO-COMPONENT DEVELOPER AND IMAGE-FORMING METHOD FOR WHICH THE DEVELOPER IS ADAPTED

[75] Inventors: Ryuji Nishiyama; Akira Fukano, both of Kadoma; Koji Harakawa; Makoto Miura, both of Shizuoka, all of Japan

[73] Assignees: Matsushita Electric Industrial Co., Ltd., Osaka; Tomoegawa Paper Co., Ltd., Tokyo, both of Japan

[21] Appl. No.: 533,831

[22] Filed: Sep. 26, 1995

[30] Foreign Application Priority Data

Sep. 30, 1994 [JP] Japan ..... 6-236398

[51] Int. Cl.$^6$ ..... G03G 9/083

[52] U.S. Cl. ..... 430/106.6; 430/126

[58] Field of Search ..... 430/106, 106.6, 430/126

[56] References Cited

U.S. PATENT DOCUMENTS 5,482,806 1/1996 Suzuki et al. ..... 430/106.6

5,484,676 1/1996 Takasu ..... 430/106.6

*Primary Examiner*—John Goodrow

*Attorney, Agent, or Firm*—Wenderoth, Lind & Ponack

[57] ABSTRACT

A two-component developer suitable for use with an image-forming apparatus which permits the removal and recovery of a toner remaining on a photoconductive drum after the transfer of the toner to a receptor sheet without using cleaning means, comprising a toner formed of toner matrix particles containing a binder resin and a colorant as main components, and a magnetic powder adhering to a surface of each toner matrix particle, and a magnetic carrier having a saturation magnetization of 90 to 200 emu/g in an external magnetic field of 3,000 oersted.

17 Claims, 2 Drawing Sheets

TWO-COMPONENT DEVELOPER AND IMAGE-FORMING METHOD FOR WHICH THE DEVELOPER IS ADAPTED

FIELD OF THE INVENTION

The present invention relates to a two-component developer used for an electrophotographic apparatus, particularly for an image-forming method which permits the concurrent performances of a development step and a cleaning step in a developing apparatus without using a cleaner for cleaning off a toner remaining on a photoconductive drum, and a method for forming an image with the two-component developer.

PRIOR ART OF THE INVENTION

A conventional image-forming method using an electrophotographic apparatus such as a copying machine or printer is generally as follows.

FIG. 3 shows a conventional image-forming method in an electrophotographic apparatus. The surface of a rotating photoconductive drum 2 is charged with a charging device 1 so that the photoconductive drum 2 surface has predetermined polarity. Then, a latent image is formed on the photoconductive drum 2 with an exposure means 3 such as lamp or laser light. The formed latent image is developed with a developing device 4, and the developed image is transferred to a receptor sheet 6 with a transfer device 5 to give a print through a fixing step. The transfer efficiency of the developed image is generally approximately 70 to 80%, and approximately 20 to 30% of the toner remains on the photoconductive drum 2. For this reason, after the transfer, a cleaning member 7 is brought into contact with the photoconductive drum 2 to scrape off and recover the remaining toner. The cleaning member 7 is formed of a urethane rubber blade or a cylindrical brush of an acrylic fiber.

There is another method using an electrophotographic apparatus from which a cleaning member is removed. The main problem with this method is, however, that the phenomenon of a toner remaining on the photoconductive drum after the transfer and showing a residual image on a subsequent copy or print ("memory" hereinafter) is not completely solved. In general practice, therefore, the memory is prevented by a method in which the particle diameter of the toner is increased or a charge having reverse polarity is applied to a memory-removing member such as an electrically conductive brush to decrease the remaining toner.

For example, JP-A-64-50089, JP-A-64-20587 and JP-A-64-59286 disclose a memory-removing member.

On the other hand, for example, JP-A-1-118875 discloses a two-component developer for use with an image-forming method using no cleaning means. This two-component developer is formed of a toner and a carrier; the toner is constituted of a styrene-n-butyl methacrylate copolymer (Hymer SBM-73, Sanyo Chemical Industries, Ltd.), carbon black (MA-100, Mitsubishi Chemical Corporation), water-based colloidal silica (R972, Nippon Aerosil Corp.) and a charge controlling agent, and the carrier has a saturation magnetization of about 60 emu/g in an external magnetic field of 3,000 oersteds, such as Cu—Zn ferrite, Mn—Cu—Zn ferrite and Zn ferrite.

The defect of the conventional constitution shown in FIG. 3 is that the cleaning member exerts a high load on the photoconductive drum, and causes fine scratches on the photoconductive drum surface and a filming or fusion of a toner on the photoconductive drum surface. The disposal of the toner recovered by the above method is also a problem in view of environmental pollution. This problem seems to become more serious to make it necessary to take immediate measures.

Further, in the electrophotographic apparatus having no cleaning member, it is required to provide an electrically conductive brush to apply a charge having reverse polarity for removing a remaining toner, and it is required to increase the particle diameter of the toner to improve transfer properties, so that these requirements prevent the decreasing of cost of the apparatus per se and the decreasing of the toner particle diameter for high-quality images.

Further, the two-component developer according to the above prior art technique has a practical problem since it is not sufficient for preventing the occurrence of the memory on the surface of the photoconductive drum.

SUMMARY OF THE INVENTION

It is an object of the present invention to provide a two-component developer suitable for use with an image-forming apparatus which permits the removal and recovery of a toner remaining on a photoconductive drum after the transfer of the toner to a receptor sheet without using cleaning means, and an image-forming method using the two-component developer.

It is another object of the present invention to provide a two-component developer which is free from causing the memory when used with an image-forming apparatus which permits the removal and recovery of a toner remaining on a photoconductive drum after the transfer of the toner to a receptor sheet without using cleaning means, and an image-forming method using the two-component developer.

According to the present invention, there is provided a two-component developer for use with an image-forming apparatus having a photoconductive drum, means of forming an electrostatic latent image on the photoconductive drum, developing means of converting the formed electrostatic latent image to a visible image with a magnetic brush of the two-component developer formed on a developing sleeve, transfer means of transferring a developed toner to a receptor sheet, and means of recovering untransferred toner remaining on the photoconductive drum concurrently with the development after the transfer, the two-component developer comprising a toner formed of toner matrix particles containing a binder resin and a colorant as main components, and a magnetic powder adhering to a surface of each toner matrix particle, and a magnetic carrier having a saturation magnetization of 90 to 200 emu/g in an external magnetic field of 3,000 oersted.

According to the present invention, further, there is provided a method for forming an image, which comprises the steps of forming an electrostatic latent image on a photoconductive drum, developing the formed electrostatic latent image to a visible image with a magnetic brush of a two-component developer formed on a developing sleeve, transferring the developed image to a receptor sheet, and recovering toner remaining on the photoconductive drum after the transfer concurrently with the development, the two-component developer comprising a toner formed of toner matrix particles containing a binder resin and a colorant as main components, and a magnetic powder adhering to a surface of each toner matrix particle, and a magnetic carrier having a saturation magnetization of 90 to 200 emu/g in an external magnetic field of 3,000 oersted, the photoconductive drum and the magnetic brush formed on the developing sleeve having a sliding clearance of 3 to 10 mm.

DETAILED DESCRIPTION OF THE INVENTION

Figure 1:
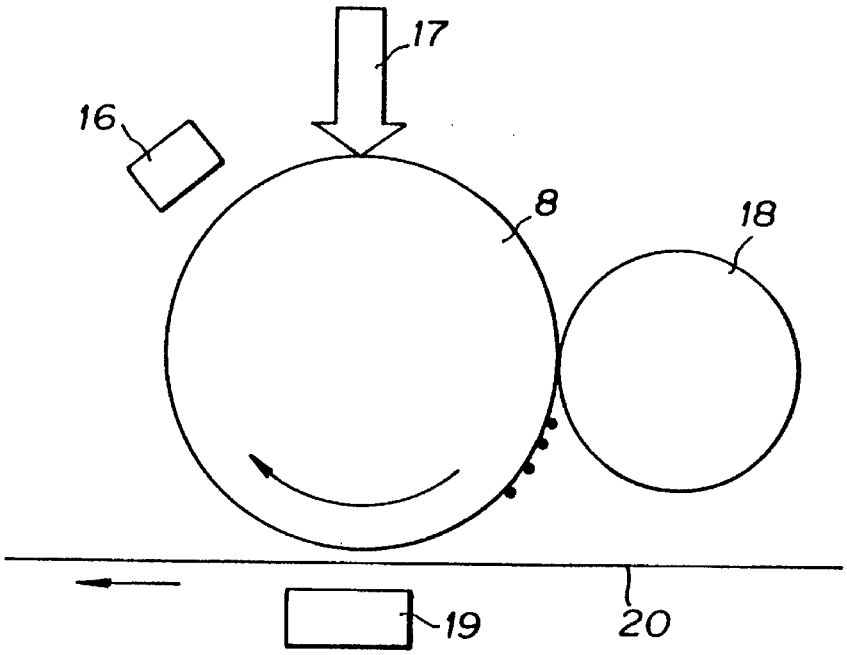
FIG. 1 is a schematic cross section of an image-forming apparatus suitable for use in the present invention.

The present invention will be explained in detail hereinafter.

The two-component developer of the present invention comprises a toner formed of toner matrix particles containing a binder resin and a colorant as main components, and a magnetic powder adhering to a surface of each toner matrix particle, and a magnetic carrier having a saturation magnetization of 90 to 200 emu/g in an external magnetic field of 3,000 oersted.

Constitution of Toner

The binder resin contained in the toner matrix particles can be selected from a styrene resin, a styrene-acrylate copolymer resin, a styrene-butadiene copolymer resin, a polyester resin and an epoxy resin.

The colorant contained in the toner matrix particles can be selected from carbon black, a monoazo-based red dye, a disazo-based yellow pigment, a quinacridone-based magenta pigment and an anthraquinone dye.

Further, in addition to the binder resin and the colorant, the toner matrix particles may further contain a charge controlling agent and other additive(s) as required.

The toner matrix particles are obtained by mixing the above binder resin, the above colorant and the above optional materials in a desired mixing ratio, melt-kneading the mixture, cooling it to solidness, pulverizing the resultant solid and classifying it. In addition, the toner matrix particles may be a so-called polymerization method toner, obtained by mixing the above materials when the binder resin is produced by polymerization.

The charge controlling agent is selected from a nigrosine dye, quaternary ammonium salt and monoazo-based metal complex salt dye.

Examples of the other additives include polyolefins as a lubricant, and hydrophobic silica and colloidal silica as a fluidizing agent.

The toner used in the present invention is formed of the above toner matrix particles and a magnetic powder adhering to a surface of each toner matrix particle. The magnetic powder is selected from powders having a composition of magnetite or ferrite. The magnetic powder preferably has the form of an octahedron, an average particle diameter of 0.3 to 0.7 μm and a saturation magnetization of at least 50 emu/g in an external magnetic field of 1,000 oersteds. The amount of the magnetic powder adhering to the matrix particles based on the matrix particles is preferably 0.3 to 3% by weight. When the amount of the magnetic powder is less than 0.3% by weight, a large amount of the toner remains on the photoconductive drum after the transfer and causes the memory. When the above amount is greater than 3%. by weight, no memory occurs, while no highly precise and fine image is obtained since the image quality deteriorates, particularly, due to the scattering of the toner around characters (letters) and the deterioration of fine lines.

The characteristic feature of the magnetic powder used in the present invention is that the particle diameter of the magnetic powder is about 2 times larger than that of magnetite, etc., incorporated into a conventional magnetic toner. The magnetic powder having a particle diameter in the above range produces an effect that the powder has excellent polishing properties so that the photoconductive drum as a whole can be uniformly cleaned. It is required to bond this magnetic powder to the surface of the toner matrix particles uniformly and firmly to some extent. For this purpose, it is preferred to use a stirrer which can provide a shear force at a high velocity. For example, the stirrer is selected from a Henschel mixer, a super mixer, a turbulizer, and others generally used for the surface modification of powders such as a Hybridizer (supplied by Nara Machinery Co., Ltd.), an Angmill (supplied by Hosokawa Micron Corporation) and a Turbo-mill (supplied by Turbo Industries Co., Ltd. The average particle diameter of the magnetic powder is determined by taking an SEM photograph of about 100 pieces of magnetic powder particles on one screen and counting numbers of the particles on the basis of graduations of 0.1 μm.

As a function and effect produced by the adhering of the magnetic powder to the surface of the toner matrix particles, there are the above cleaning effect and the above effect on the prevention of scattering of the toner. In particular, the magnetic powder having a saturation magnetization of at least 50 emu/g is effective for preventing the scattering of the toner. Further, the toner used in the present invention preferably has an average particle diameter of 5 to 9 μm for providing highly fine images.

Constitution of Carrier

The magnetic carrier used in the present invention can be selected from resin-coated or noncoated ferrite, an iron oxide powder, granulated magnetite and a resin carrier, while it is required to have a saturation magnetization of 90 to 200 emu/g in an external magnetic filed of 3,000 oersteds. The above "resin carrier" refers to a pulverization product obtained by dispersing a magnetic powder in a binder resin, melt-kneading the dispersion and pulverizing the kneaded mixture. When the magnetic carrier has a saturation magnetization of less than 90 emu/g, the sliding clearance is smaller than the lower limit of 3 mm in a cleaner-less system. As a result, a memory phenomenon on the photoconductive drum is not completely removed, or it remains. When the saturation magnetization exceeds 200 emu/g, the sliding clearance is large to excess and has an adverse effect on images, and no highly fine image is obtained. The magnetic carrier preferably has a volume resistivity of $10^3$ to $10^{10}$ Ω·cm when the charged voltage is 100 V. When the volume resistivity of the magnetic carrier is less than $10^3$ Ω·cm, an image formed with a cleaner-less copying machine shows that the toner is adhering not only to an image portion but also to a non-image portion on the photoconductive drum to cause a background and the scattering of the toner on the photoconductive drum, and as a result, the quality of the image as a whole is poor. When the above volume resistivity is higher than $10^{10}$ Ω·cm, the image density decreases at the initial time of, and during, the continuous copying operation, and the memory remains to a great extent.

As the magnetic carrier in the present invention, an iron oxide powder is particularly preferred, since it has an good effect on the removal of the memory and the image quality. As an iron oxide powder, a mixture containing 2 to 60% by weight of flat iron oxide powder and 40 to 98% by weight of particulate iron oxide powder, preferably 5 to 50% by weight of flat iron oxide powder and 50 to 95% by weight of particulate iron oxide powder, is effective for removing the above memory. The flat magnetic carrier has features in that it has a form similar to scales, has a large contact area to the photoconductive drum and has high contact strength. When a flat iron oxide powder is used alone, the image density rarely fluctuates even if the toner content in the two-component developer varies. However, the flat iron oxide has an excessively high image-scraping effect so that it exerts a high stress on the photoconductive drum and re-scrapes off the toner developed on the photoconductive drum, so that it is difficult to obtain highly fine images. Nevertheless, the use of a flat iron oxide alone is effective against the memory, and the magnetic carrier may be formed of a flat iron oxide alone depending upon the design of an image-forming apparatus.

On the other hand, the particulate magentic carrier has features in that it is of aggregates of spherical carriers and contrasts with the flat carrier.

That is, the particulate magnetic carrier has a smaller contact area to the photoconductive drum and lower contact strength than the flat magnetic carrier. When the particulate magnetic carrier alone is used, the image density varies to a great extent if the toner content in the two-component developer varies, while it can give excellent images compared with the flat magnetic carrier. However, the particulate magnetic carrier is poor in the effect of scraping off the remaining toner on the photoconductive drum as compared with the flat one. Therefore, when the magnetic carrier is formed of a mixture containing a flat magnetic carrier effective for the removal of the memory and a particulate magnetic carrier effective for high-quality images, both the removal of the memory and the achievement of highly fine and accurate images can be satisfied.

In the present invention, it is therefore preferred to use a mixture containing 2 to 60% by weight of an iron oxide powder having a flat form and 40 to 98% by weight of an iron oxide powder having a particulate form, since the soft contact of the particulate iron oxide powder to the photoconductive drum and the large contact area of the flat iron oxide powder to the photoconductive drum produce an effect that the cleaning and the development can be concurrently performed.

The image-forming method using the above two-component developer, provided by the present invention, will be explained hereinafter with reference to FIGS. 1 and 2.

In FIG. 1, a charging device 16 charges the surface of a rotating photoconductive drum 8 such that the surface has predetermined polarity. Then, a latent image is formed on the photoconductive drum 8 with exposure means 17 such as lamp or laser light. The formed latent image is developed with a developing device 18, and the developed image is transferred to a receptor sheet 20 with a transfer device 19 and subjected to a fixing step to give a print.

Figure 2:
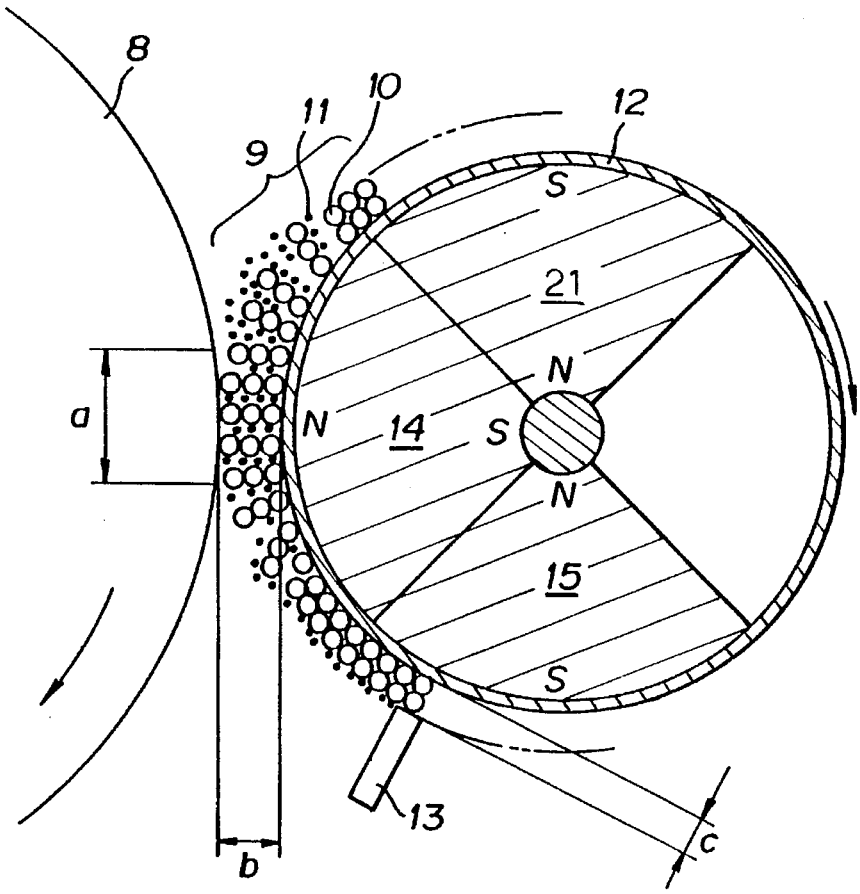
FIG. 2 is a schematic enlarged cross section of a developing portion of the image-forming apparatus shown in FIG. 1.
Figure 3:
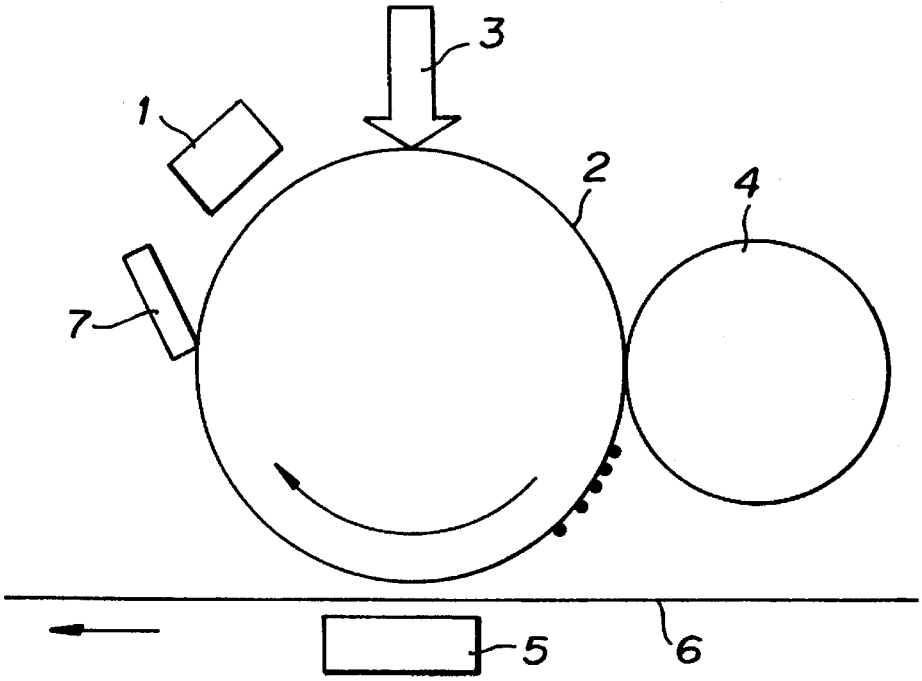
FIG. 3 is a schematic cross section of a conventional image-forming apparatus.

FIG. 2 schematically shows an enlarged contact portion of the photoconductive drum 18 and a developing sleeve 12. In FIG. 2, a is the contact width of the photoconductive drum 8 and a developer 9, and is referred to as the sliding clearance, b is the clearance between the photoconductive drum 8 and the developing sleeve 12, and c is the clearance between trimming device 13 and the developing sleeve 12. The sliding clearance a is determined by c, b, the radius of the photoconductive drum 8 and the radius of the developing sleeve 12. For example, the sliding clearance a can be broadened by broadening c and narrowing b. For decreasing the sliding clearance a, reversely, c is narrowed and b is broadened. Alternatively, the sliding clearance a can be broadened by increasing the radii of the photoconductive drum and the developing sleeve, and the sliding clearance can be decreased by decreasing these radii. However, for determining the sliding clearance a, it is necessary to study the optimum values of image density, background, image quality, adherence of the developer to the photoconductive drum 8, and the like.

In the present invention, the sliding clearance a between the photoconductive drum 8 and the developer 9 (mixture of a carrier 10 and a toner 11) is required to be 3 to 10 mm. The sliding clearance a is one of the most important factors, and when the sliding clearance is not within 3 to 10 mm, the image-forming method free of a cleaning member cannot be carried out. The reason for the limitation of the sliding clearance to 3 to 10 mm is as follows. When the sliding clearance is greater than 10 mm, the amount of a toner used for the development is too large to obtain a highly fine image. When it is smaller than 3 mm, the removal of the memory is insufficient, and the image density is low.

The ratio of the peripheral speed of the photoconductive drum 8: the peripheral speed of the developing sleeve 12 can be in the range of 1:1 to 1:10 depending upon the design condition of the apparatus such as the clearance between these two members. In a with-mode (when the rotational direction of the photoconductive drum is reverse to that of the developing sleeve), the ratio of the peripheral speed of the photoconductive drum: that of the developing sleeve is preferably 1:1.5 to 3.0. In an against-mode (when the rotational direction of the photoconductive drum is the same as that of the developing sleeve), the ratio of the peripheral speed of the photoconductive drum: that of the developing sleeve is preferably 1:3 to 5.

The above-specified sliding clearance can be attained when the clearance b between the photoconductive drum 8 and the developing sleeve 12 is 0.6 to 1.5 mm and when the clearance c between the developing sleeve 12 and the trimming device 13 is 0.6 to 1.2 mm. In this case, the photoconductive drum 8 has a radius of 8 to 50 mm, and the developing sleeve 12 has a radius of 8 to 30 mm.

The developing sleeve 12 includes a main pole 14 of a fan-shaped permanent magnet and secondary poles 15, 21 of which the N and S poles are positioned reversely to those of the main pole 14. The developing sleeve 12 rotates in the direction indicated by an arrow in FIG. 2, while the positions of the main pole 14 and the secondary poles 15, 21 are fixed. In the developing sleeve shown in FIG. 2, the main pole 14 is a magnetic which is designed such that it has the highest magnet flux density in the direction closest to the photoconductive drum 8 and has a lower magnetic flux density toward its peripheral portions. Each of the secondary poles 15, 21 is also a magnet which is designed such that it has the highest magnetic flux density in its central portion and has a lower magnetic flux density toward its peripheral portions. The secondary pole located on the upstream side of the main pole 14 is called a trimming pole.

The maximum magnetic flux density of a main pole 14 of a permanent magnet included in the developing sleeve 12 is at least 700 Gauss, and the half-value width angle thereof (angle of magnetic pole at which at least ½ of the maximum magnetic flux density is exhibited) is at least 40 degrees, preferably at least 50 degrees. When the maximum magnetic flux density of the main pole is less than 700 Gauss, or when the half-value width angle is less than the above value, the sliding clearance and the sliding strength decrease, which decrease also occurs when the saturation magnetization of the magnetic carrier is low. As a result, the memory remains. The positional relationship between a trimming pole 15 of a permanent magnet included in the developing sleeve 12 and the trimming device 13 is as follows. The trimming is effectively carried out when the trimming device is positioned in a site of which the magnetic flux density is in a range of 0 to 70%, preferably 15 to 60%, of the maximum magnetic flux density of the trimming pole and toward the photoconductive drum. The above "0%" refers to a magnetic flux density in the vicinity of a boundary between the main pole and the trimming pole. When the magnetic flux density in the trimming position exceeds the above upper limit, not only the amount of the developer to pass the trimming device 13 decreases, but the developer varies in amount. Therefore, the image density decreases and varies, the sliding property deteriorates, and the memory remains.

Having the above constitution, the present invention is improved in the transfer of the toner and the recovery of the remaining toner in the developing portion. As a result, there can be provided an image-forming method which requires neither a cleaning member nor a memory-removing member (i.e., an electrically conductive brush).

According to the present invention, the two-component developer provided by the present invention is suitable for use with an image-forming apparatus having a photoconductive drum, means of forming an electrostatic latent image on the photoconductive drum, developing means of converting the formed electrostatic latent image to a visible image with a magnetic brush of the two-component developer formed on a developing sleeve, transfer means of transferring a developed toner to a receptor sheet, and means of recovering untransferred toner remaining on the photoconductive drum concurrently with the development after the transfer. Further, there is provided an image-forming method for which the above two-component developer is adapted.

According to the present invention, the two-component developer provided by the present invention is suitable for forming an image on a receptor sheet without causing the memory while removing and recovering a residual toner remaining on the photoconductive drum after the transfer without any cleaning means or memory-removing means, e.g., an electrically conductive brush. Further, there is also provided an image-forming method for which the above two-component developer is adapted.

Examples

The present invention will be explained further in detail hereinafter with reference to Examples, in which "part" stands for "part by weight".

Example 1

Styrene-acrylate copolymer resin (trade name: Hymer TB-1000, supplied by Sanyo Chemical Industries, Ltd.) 100 parts Polypropylene (trade name: Hymer 330P, supplied by Sanyo Chemical Industries, Ltd.) 3 parts Charge controlling agent (trade name: Bontron S-34, supplied by Orient Chemical Industries, Ltd.) 1 part Carbon black (trade name: MA-100, supplied by Mitsubishi Chemical Corporation.) 6 parts The above materials were mixed with a super mixer, melt-kneaded, then pulverized and classified to give negatively chargeable toner matrix particles having an average particle diameter of 8.5 μm. Then, 1.5 parts of a magnetite fine powder (trade name: KBF-100, supplied by Kanto Denka Kogyo Co., Ltd., average particle diameter: 0.45 μm, saturation magnetization: 59 emu/g) and 0.3 part of hydrophobic silica (trade name: R-972, supplied by Nippon Aerosil Corp.) were mixed with 100 parts of the above toner matrix particles with a Henschel mixer to allow the above magnetic powder to adhere to the surface of the toner matrix particles, and the resultant product was classified through a 200-mesh sieve with a Gyro shifter to give a toner to be used in the present invention.

Then, 100 parts of a magnetic carrier obtained by coating a core material of an iron oxide powder (flat form: 15%, particulate form: 85%) having an average particle diameter of 60 μm, a saturation magnetization of 200 emu/g and a volume resistivity of $10^6$ Ωcm with a silicone resin, and 4 parts of the above-obtained toner were mixed, to give a two-component developer of the present invention.

The so-obtained two-component developer was used for carrying out a 5,000 copies printing test with a laser printer having a mechanism shown in FIGS. 1 and 2. The laser printer had the following specification.

Printing method: laser scanning, Photoconductive drum: OPC, Printing rate: 8 sheets/minute at maximum, Sliding clearance: 5 mm, Peripheral speed ratio: 1:4, Magnetic flux density of main pole of magnet in developing sleeve: 800 Gauss, Half-value width angle of main pole: 50 degrees, Trimming position: 40% of the maximum magnetic flux of trimming pole of permanent magnet in developing sleeve.

Example 2

A toner and a two-component developer were obtained in the same manner as in Example 1 except that the amount of the magnetite powder was changed to 0.3 part. The two-component developer was tested in the same manner as in Example 1.

Example 3

A toner and a two-component developer were obtained in the same manner as in Example 1 except that the amount of the magnetite powder was changed to 3.0 parts. The two-component developer was tested in the same manner as in Example 1.

Example 4

A toner and a two-component developer were obtained in the same manner as in Example 1 except that the magnetic carrier was replaced with a ferrite carrier having a saturation magnetization of 90 emu/g. The two-component developer was tested in the same manner as in Example 1.

Example 5

A toner and a two-component developer were obtained in the same manner as in Example 1 except that the mixing ratio of the iron oxide powder carrier was changed such that the carrier was a mixture of iron oxide powders (flat form: 5%, particulate form: 95%). The two-component developer was tested in the same manner as in Example 1.

Example 6

A toner and a two-component developer were obtained in the same manner as in Example 1 except that the mixing ratio of the iron oxide powder carrier was changed such that the carrier was a mixture of iron oxide powders (flat form: 50%, particulate form: 50%). The two-component developer was tested in the same manner as in Example 1.

Example 7

The same two-component developer as that obtained in Example 1 was tested in the same manner as in Example 1 except that the sliding clearance between the magnetic brush and the photoconductive drum was changed to 3 mm.

Example 8

The same two-component developer as that obtained in Example 1 was used for carrying out a 10,000 copies printing test with a copying machine having the following specification.

Developing method: dry two-component developing method, Sliding clearance between magnetic brush and photoconductive drum: 10 mm, Copying rate: 65 sheets/minute (A4), Magnetic flux density of main pole of permanent magnet in developing sleeve: 1,000 Gauss, Photoconductive drum: selenium, Peripheral speed ratio of photoconductive drum and developing sleeve: 1:3, Half-value width angle of main pole: 50 degrees, Trimming position: 40% of the maximum magnetic flux of trimming pole of permanent magnet in developing sleeve.

Example 9

The same two-component developer as that obtained in Example 1 was tested in the same manner as in Example 1 except that the half-value width angle of the main pole in the laser printer was changed to 60 degrees.

Example 10

The same two-component developer as that obtained in Example 1 was tested in the same manner as in Example 1 except that the half-value width angle of the main pole in the laser printer was changed to 40 degrees.

Example 11

The same two-component developer as that obtained in Example 1 was tested in the same manner as in Example 1 except that the two-component developer was trimmed in a position where the magnetic flux was 60% of the maximum magnetic flux of the trimming pole.

Example 12

The same two-component developer as that obtained in Example 1 was tested in the same manner as in Example 1 except that the two-component developer was trimmed in a position where the magnetic flux was 70% of the maximum magnetic flux of the trimming pole.

Example 13

The same two-component developer as that obtained in Example 1 was tested in the same manner as in Example 1 except that the two-component developer was trimmed in a position where the magnetic flux was 0% of the maximum magnetic flux of the trimming pole.

Example 14

A toner and a two-component developer were obtained in the same manner as in Example 1 except that the amount of the magnetite powder was changed to 0.25 part. The two-component developer was tested in the same manner as in Example 1.

Example 15

A toner and a two-component developer were obtained in the same manner as in Example 1 except that the amount of the magnetite powder was changed to 3.5 parts. The two-component developer was tested in the same manner as in Example 1.

Example 16

A toner and a two-component developer were obtained in the same manner as in Example 1 except that the mixing ratio of the iron oxide powder carrier was changed such that the carrier contained 2 parts of an iron oxide powder having a flat form and 98 parts of an iron oxide powder having a particulate form. The two-component developer was tested in the same manner as in Example 1.

Example 17

A toner and a two-component developer were obtained in the same manner as in Example 1 except that the mixing ratio of the iron oxide powder carrier was changed such that the carrier contained 60 parts of an iron oxide powder having a flat form and 40 parts of an iron oxide powder having a particulate form. The two-component developer was tested in the same manner as in Example 1.

Comparative Example 1

A toner and a developer were obtained in the same manner as in Example 1 except that the magnetic carrier was replaced with a magnetic carrier having a saturation magnetization of 70 emu/g. The developer was tested in the same manner as in Example 1.

Comparative Example 2

A toner and a developer were obtained in the same manner as in Example 1 except that the magnetic carrier was replaced with a magnetic carrier having a saturation magnetization of 220 emu/g. The developer was tested in the same manner as in Example 1.

Comparative Example 3

The same two-component developer as that obtained in Example 1 was tested in the same manner as in Example 1 except that the sliding clearance between the magnetic brush and the photoconductive drum was changed to 1.5 mm.

Comparative Example 4

The same two-component developer as that obtained in Example 1 was tested in the same manner as in Example 1 except that the sliding clearance between the magnetic brush and the photoconductive drum was changed to 13 mm.

Table 1 shows the results of evaluation of the toners obtained in Examples 1 to 17 and Comparative Examples 1 to 4. The prints and the original for the copies had a size of A4 of which 6% was black. The image density was measured with a reflection densitometer RD-914 supplied by Machbeth, and the fogging was measured with a color-difference meter MODEL Z-1001DP supplied by Nippon Denshoky Kogyo.

TABLE 1

| | | Image density | Background | Memory | Reproducibility of fine lines |
|---|---|---|---|---|---|
| Ex. 1 | Initial | 1.45 | 0.47 | A | A |
| | Last | 1.39 | 0.38 | A | A |
| Ex. 2 | Initial | 1.43 | 0.51 | A | B |
| | Last | 1.41 | 0.54 | A | B |
| Ex. 3 | Initial | 1.45 | 0.41 | A | B |
| | Last | 1.45 | 0.35 | A | B |
| Ex. 4 | Initial | 1.40 | 0.67 | A | B |
| | Last | 1.36 | 0.78 | A | B |
| Ex. 5 | Initial | 1.39 | 0.67 | A | B |
| | Last | 1.37 | 0.55 | B | B |
| Ex. 6 | Initial | 1.47 | 0.46 | A | B |
| | Last | 1.45 | 0.59 | A | B |
| Ex. 7 | Initial | 1.37 | 0.37 | A | B |
| | Last | 1.39 | 0.45 | A | B |
| Ex. 8 | Initial | 1.45 | 0.38 | A | B |
| | Last | 1.42 | 0.65 | B | B |
| Ex. 9 | Initial | 1.40 | 0.72 | A | A |
| | Last | 1.42 | 0.65 | A | B |
| Ex. 10 | Initial | 1.39 | 0.54 | C | B |
| | Last | 1.42 | 0.62 | C | B |
| Ex. 11 | Initial | 1.40 | 0.43 | A | B |
| | Last | 1.42 | 0.40 | A | B |
| Ex. 12 | Initial | 1.14 | 0.25 | C | B |
| | Last | 1.20 | 0.35 | C | B |
| Ex. 13 | Initial | 1.32 | 0.37 | B | B |
| | Last | 1.40 | 0.42 | B | C |
| Ex. 14 | Initial | 1.44 | 0.78 | C | C |
| | Last | 1.45 | 0.84 | C | C |
| Ex. 15 | Initial | 1.44 | 0.76 | B | C |
| | Last | 1.41 | 0.54 | B | C |
| Ex. 16 | Initial | 1.45 | 0.51 | A | C |
| | Last | 1.47 | 0.45 | A | C |
| Ex. 17 | Initial | 1.32 | 0.36 | C | C |
| | Last | 1.28 | 0.48 | C | C |
| CEx. 1 | Initial | 1.34 | 0.88 | X | B |
| | Last | 1.36 | 1.03 | X | B |
| CEx. 2 | Initial | 1.48 | 0.79 | B | X |
| | Last | 1.46 | 0.68 | B | X |
| CEx. 3 | Initial | 1.36 | 0.68 | C | C |
| | Last | 1.39 | 0.54 | X | C |
| CEx. 4 | Initial | 1.48 | 0.74 | B | X |
| | Last | 1.48 | 0.95 | C | X |

Ex. = Example,
CEx. = Comparative Example

In the evaluation of the memory, that portion of a print image which corresponded to a second rotation of the photoconductive drum was visually observed for an image of a residual toner.

Ratings of the Memory

A: No memory was observed.

B: Slight memory was observed.

C: Memory was observable.

X: Clear memory was observed.

In the above ratings, a copy or a print which is evaluated to be A, B or C is considered to be free of any problem in practical use.

The reproducibility of fine lines was evaluated with an image analyzing apparatus supplied by Japan Abionics Co., Ltd. as follows. The length of a latent image was defined with a computer, and an image formed of a toner was sampled. A value obtained by deducting the length of the latent image from the side line length of the formed image is referred to as "fluctuation value". This fluctuation value is considered to show the reproducibility of the latent image, and the smaller the value is, the more superior the fine lines are.

Fluctuation value=Side line length of formed image−1,320 (length of latent image); unit: μm.

Figure 4A:
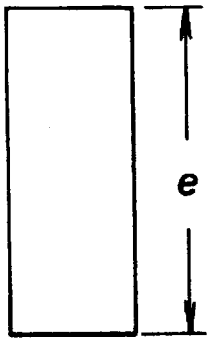
FIG. 4 explains the image quality evaluation method used in the present invention.
Figure 4B:
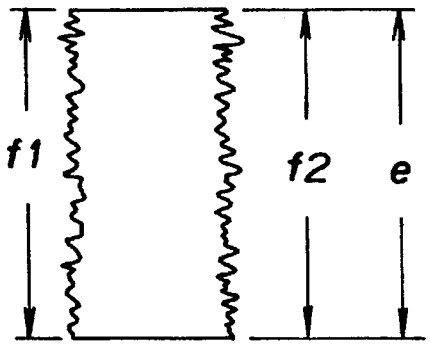

The fluctuation value will be explained more in detail below with reference to FIG. 4. In FIG. 4, (A) shows the length of a latent image, and (B) shows the side line length of a formed image. The length e of the latent image was fixed to be 1,320 μm. Some prints or copies were prepared from the above latent image, and the side line length of the formed image [(f1+f2)/2, in which f1 and f2 are length values of side lines measured along their zig-zag side lines] was determined. Then, the length of the latent image was deducted from the side line length of the formed image.

Ratings of Fine Lines (Fluctuation Value: μm)

A: Less than 800 (nearly linear even when an image is enlarged).

B: 800–1,000 (excellent in linearity when an image is visually observed)

C: 1,000–1,300 (slightly poor in linearity when an image is visually observed)

X: More than 1,300 (clearly poor in linearity)

In the above ratings, a copy or a print which is evaluated to be A, B or C is considered to be free of any problem in practical use.

As is clearly shown in Table 1, the two-component developers and the image-forming methods in Examples according to the present invention are excellent in the formation of images free from the occurrence of the memory without any cleaning member or any additional device.

What is claimed is:

1. A two-component developer for an electrophotographic image-forming apparatus, said developer comprising a toner formed of toner matrix particles containing a binder resin and a colorant as main components and a magnetic powder adhering to a surface of each toner matrix particle, said powder being present in an amount of 0.3 to 3% by weight based on the toner matrix particles, and a magnetic carrier having a saturation magnetization of 90 to 200 emu/g in an external magnetic field of 3,000 oersted.

2. A two-component developer according to claim 1, wherein the magnetic powder has an average particle diameter of 0.3 to 0.7 μm and has a saturation magnetization of at least 50 emu/g in an external magnetic field of 1,000 oersteds.

3. A two-component developer according to claim 1, wherein the toner has an average particle diameter of 5 to 9 μm.

4. A two-component developer according to claim 1, wherein the magnetic carrier is formed of 2 to 60% by weight of a flat magnetic carrier and 40 to 98% by weight of a particulate magnetic carrier.

5. A two-component developer according to claim 1, wherein the magnetic carrier is formed of 5 to 50% by weight of a flat magnetic carrier and 50 to 95% by weight of a particulate magnetic carrier.

6. A two-component developer according to claim 1, wherein the magnetic carrier has a volume resistivity of $10^3$ to $10^{10}$ Ω·cm at a charged voltage of 100 V.

7. A method for forming an image, which comprises the steps of forming an electrostatic latent image on a photoconductive drum, developing the formed electrostatic latent image to a visible image with a magnetic brush of a two-component developer formed on a developing sleeve, transferring the developed image to a receptor sheet, and recovering toner remaining on the photoconductive drum after the transfer concurrently with the development, the two-component developer comprising a toner formed of toner matrix particles containing a binder resin and a colorant as main components, and a magnetic powder adhering to a surface of each toner matrix particle said powder being present in an amount of 0.3 to 3% by weight based on the toner matrix particles, and a magnetic carrier having a saturation magnetization of 90 to 200 emu/g in an external magnetic field of 3,000 oersted, the photoconductive drum and the magnetic brush formed on the developing sleeve having a sliding clearance of 3 to 10 mm.

8. A method according to claim 7, wherein the magnetic powder has an average particle diameter of 0.3 to 0.7 μm and has a saturation magnetization of at least 50 emu/g in an external magnetic field of 1,000 oersteds.

9. A method according to claim 7, wherein the toner has an average particle diameter of 5 to 9 μm.

10. A method according to claim 7, wherein the magnetic carrier is formed of 2 to 60% by weight of a flat magnetic carrier and 40 to 98% by weight of a particulate magnetic carrier.

11. A method according to claim 7, wherein the magnetic carrier has a volume resistivity of $10^3$ to $10^{10}$ Ω·cm at a charged voltage of 100 V.

12. A method according to claim 7, wherein the photoconductive drum and the developing sleeve are rotated at a photoconductive drum: developing sleeve peripheral speed ratio of 1:1 to 1:10.

13. A method according to claim 7, wherein the developing step uses a developing sleeve provided with a permanent magnet having a maximum magnetic flux density of at least 700 Gauss and a half-value width angle of at least 40 degrees.

14. A method according to claim 13, wherein the permanent magnet has a half-value width angle of at least 50 degrees.

15. A method according to claim 7, wherein the developing step uses a trimming device positioned outside the developing sleeve in a developing sleeve radius direction.

16. A method according to claim 15, wherein the trimming device is positioned in a site of which the magnetic flux density is 0 to 70% of a maximum magnetic flux density of a trimming pole and toward the photoconductive drum.

17. A method according to claim 15, wherein the trimming device is positioned in a site of which the magnetic flux density is 15 to 60% of a maximum magnetic flux density of a trimming pole and toward the photoconductive drum.

* * * * *